US006725863B2

(12) United States Patent
Karpel

(10) Patent No.: US 6,725,863 B2
(45) Date of Patent: Apr. 27, 2004

(54) CHOKING ASSISTANCE DEVICE

(76) Inventor: Louis M. Karpel, 62 Buggywhip Trail, Honeoye Falls, NY (US) 14472

( * ) Notice: Subject to any disclaimer, the term of this patent is extended or adjusted under 35 U.S.C. 154(b) by 0 days.

(21) Appl. No.: 10/121,834

(22) Filed: Apr. 12, 2002

(65) Prior Publication Data

US 2002/0156405 A1 Oct. 24, 2002

Related U.S. Application Data

(60) Provisional application No. 60/284,646, filed on Apr. 18, 2001.

(51) Int. Cl.[7] ..... A61G 1/04
(52) U.S. Cl. ..... 128/845; 606/201
(58) Field of Search ..... 128/845, 846; 606/201; 482/121, 122, 126, 128

(56) References Cited

U.S. PATENT DOCUMENTS

| | | | | |
|---|---|---|---|---|
| 1,535,822 | A | 4/1925 | Goodwin | |
| 3,401,686 | A | 9/1968 | Edwards | 128/28 |
| 4,059,099 | A | 11/1977 | Davis | 128/28 |
| 4,164,216 | A | 8/1979 | Person | 128/28 |
| 4,182,317 | A | 1/1980 | Ash | 128/28 |
| 4,726,357 | A | 2/1988 | DeStefano | 128/28 |
| D321,937 | S | 11/1991 | Young | D24/133 |
| D363,554 | S | 10/1995 | Psaros | D24/200 |
| D363,991 | S | 11/1995 | Benware et al. | D24/200 |
| D381,754 | S | 7/1997 | Fani | D24/200 |
| 5,651,755 | A | 7/1997 | Chen | 482/128 |
| 5,722,987 | A | 3/1998 | Witbeck | 606/201 |

*Primary Examiner*—Michael A. Brown
(74) *Attorney, Agent, or Firm*—Brown & Michaels PC; Eugene Stephens & Associates

(57) ABSTRACT

A choking assistance device includes a head specially designed for placement against the abdomen of a choking victim for performance of the Heimlich Maneuver. The head has lateral extensions and, in the preferred embodiment, a central bulge. The choking assistance device also has a spacing rod attached to the head with appropriately located handles and a non-slip base pad.

18 Claims, 3 Drawing Sheets

CHOKING ASSISTANCE DEVICE

This application claims the benefit of U.S. Provisional Application No. 60/284,646, filed on Apr. 18, 2001, which provisional application is incorporated by reference herein.

TECHNICAL FIELD

My invention deals generally with apparatus intended to assist in the performance of the Heimlich Maneuver to help a choking victim. More specifically, it deals with equipment that the choking victim can use without outside assistance to perform the Heimlich Maneuver on himself or herself.

BACKGROUND OF THE INVENTION

Thousands of people in the United States die each year from accidental choking. For many years, medical opinion differed as to the most-effective way to deal with accidental choking. Often sharp blows to the back, finger sweeps of the throat, and manual thrusts to the chest were attempted. These methods proved to be not only useless and ineffectual in most cases, but to actually be harmful to the choking victim. In 1985, the American Red Cross, the American Heart Association, and the Surgeon General of the United States determined that methods other than the Heimlich Maneuver can be dangerous and that only the Heimlich Maneuver should be used to treat a choking victim.

Henry J. Heimlich, M.D., devised the Heimlich Maneuver in the early 1970s. It depends for its success on the fact that a choking victim's lungs have a large volume of air in them even if the person was exhaling when the choking began. If a rescuer presses sharply and repeatedly on the victim's abdomen, with one balled fist wrapped in the opposite hand, at a point just above the navel, but below the rib cage and the diaphragm, that reservoir of air is expelled up the airway with a great force. This serves to dislodge the obstruction from the victim's throat.

The Heimlich Maneuver is generally safe and effective. In addition, the average person usually can master it. However, it is far easier for a rescuer to perform this maneuver on the victim than for the victim to assist himself (or herself) in this way. The rescuer, who stands behind the victim, has his arms partially extended and is therefore properly positioned to exert the squeezing compressive force required for the success of the Heimlich Maneuver. The individual victim, acting alone, must try to press his fists and hands against his own abdomen (without any extension or proper leverage) with sufficient force to effect the expulsion of food or some other item from his own throat. This is rendered even more difficult by the fact that the victim is in the process of choking and may be close to unconsciousness as well as substantially weakened.

In addition, many choking victims are elderly people who live alone. Not only are these individuals the most likely to be afflicted by a choking emergency without any available person to assist nearby, they are often frail and would find it difficult to perform the Heimlich Maneuver on themselves at the best of times. When they are in the process of choking, and possibly panicked, their chances of survival are extremely small. There is, therefore, a great need for some type of apparatus to assist individuals in performing the Heimlich Maneuver on themselves.

To date, most devices that have been developed to assist in the performance of the Heimlich Maneuver have featured a ball or dome-shaped head to be pressed against the victim's abdomen. Usually some type of handles are attached to the head to facilitate the device's use by the rescuer. These devices may assist the rescuer and help to prevent bruising of the victim's abdomen, but they do not provide the leverage and positioning needed by the victim in performing the Heimlich Maneuver on himself.

Only two devices known to the applicant have been adapted for use by a victim by including a spacing rod to provide leverage for self use. U.S. Pat. No. 4,164,216, issued to Person in 1979, for a "Throat Obstruction Expulsion Device", features a spacing rod with a sliding tube mounted thereon. The tube has handles and a disc-shaped head. The spacing rod has a foot for resting or mounting on a tabletop or other surface. In order to use the device, the choking victim places the head of the device against his abdomen and uses the handles on the sliding tube to thrust the head inward and upward so as to perform the Heimlich Maneuver. U.S. Pat. No. 4,182,317, issued to Ash in 1980, for an "Object Dislodging Method and Apparatus", uses a dumbbell-shaped arrangement with two heads connected by a spacing rod. In this device, one head is gripped in order to force the other head against the user's abdomen. Although the basic principles underlying these prior art attempts are sound, neither device has a head that is well shaped or proportioned for use in the self-performance of the Heimlich Maneuver.

SUMMARY OF THE INVENTION

My invention is characterized by a head having lateral extensions and, in the preferred embodiment, a central bulge. It also has a spacing rod with appropriately located handles and a non-slip base pad. The design and construction of my invention optimizes its performance as a Heimlich Maneuver device, turning it into a truly practical apparatus for the use of either a victim or rescuer.

DESCRIPTION OF THE INVENTION

Figure 1:
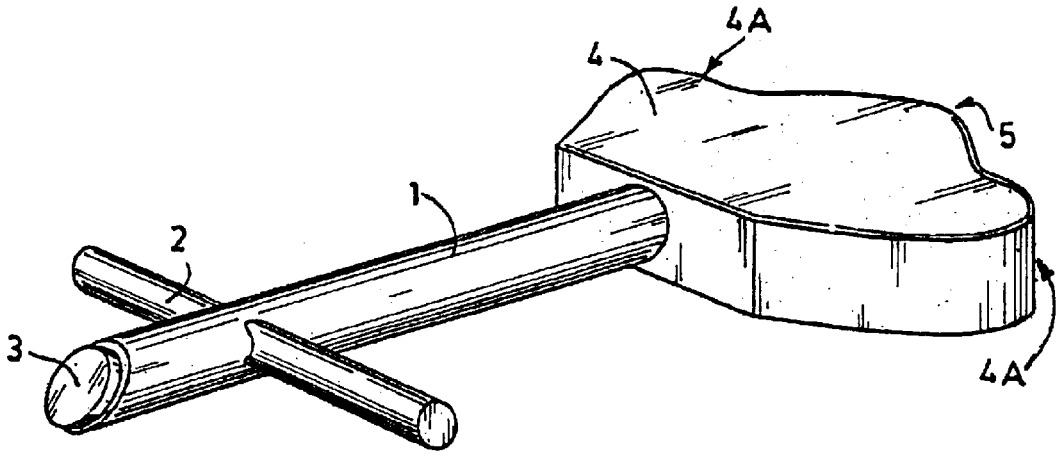
FIG. 1 provides a perspective view of my invention.
Figure 2:
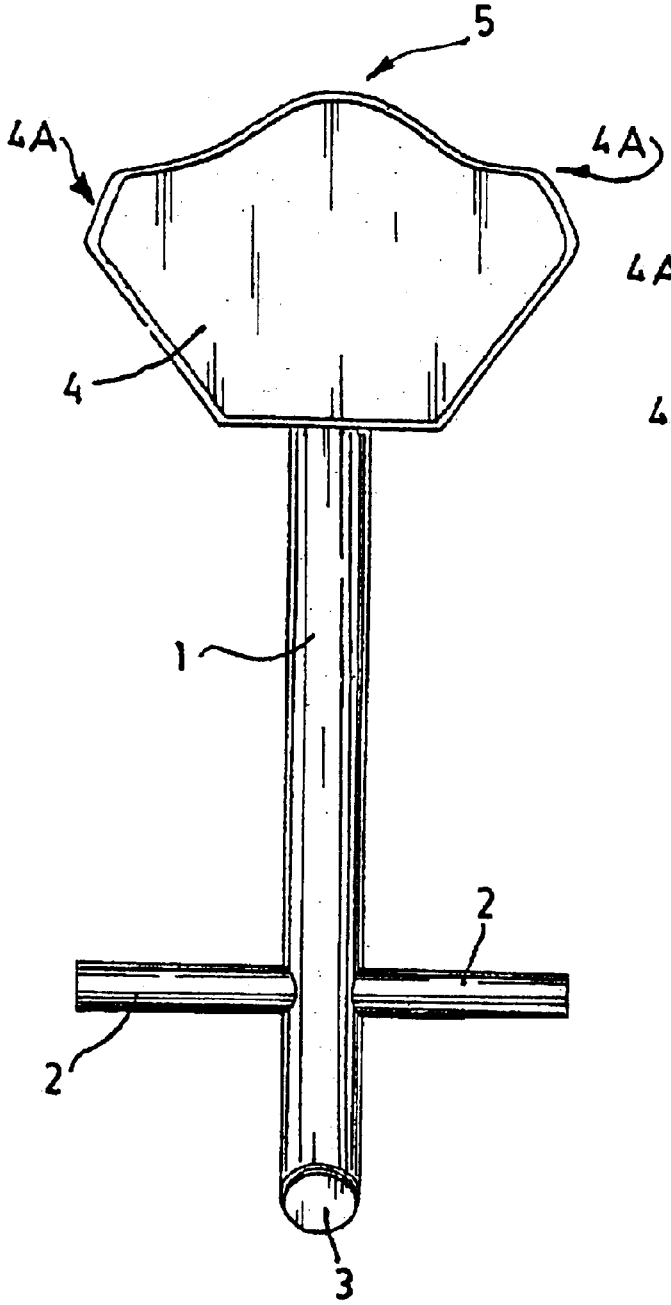
FIG. 2 provides an overhead view of my invention.
Figure 3:
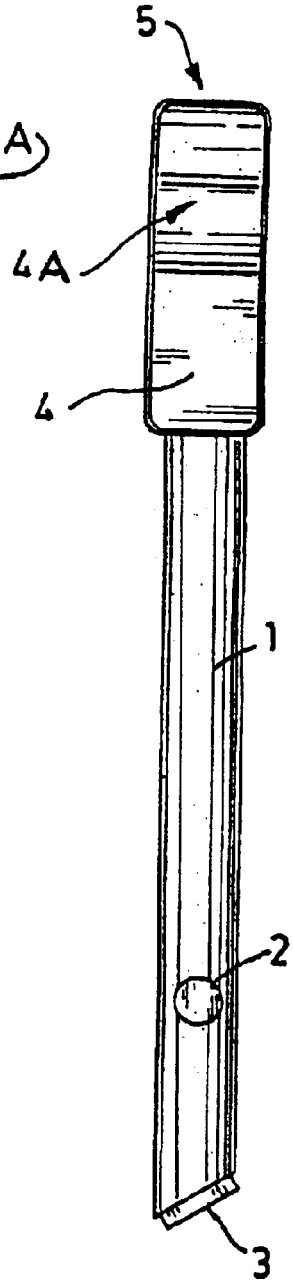
FIG. 3 provides a side view of my invention.
Figure 4:
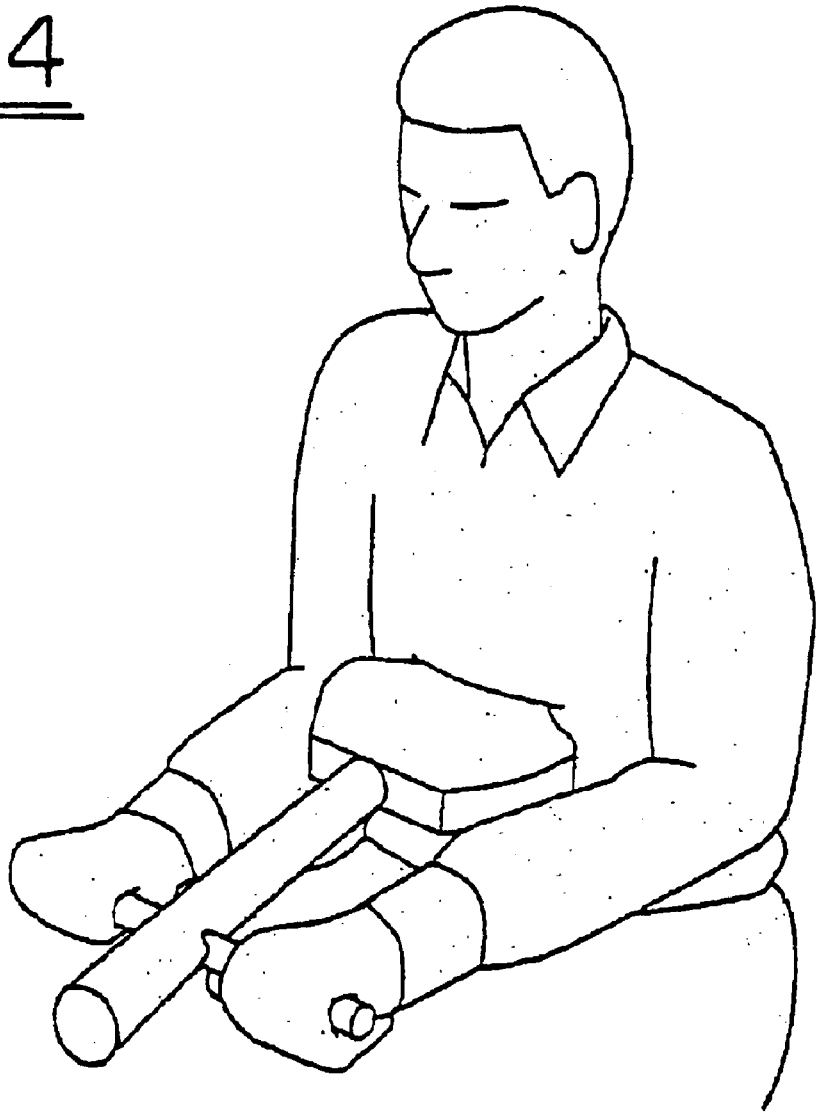
FIG. 4 provides a perspective view of my invention illustrating its intended manner of use.

The Heimlich Maneuver is effective due to the expulsion of air from the lungs caused when the diaphragm is forced upward. The diaphragm is, in turn, forced upward by the force exerted during performance of the maneuver on the abdomen and underlying abdominal organs of the victim. This force must be appropriately focused in order to be effective. On the other hand, such a force must be exerted in a manner that does not damage the victim. My invention has been developed with the express purpose of providing appropriate force without injury. Like some other devices, it has a spacing rod 1 with handles 2. It also possesses an end pad 3 and a head 4. The non-slip end pad 3 of my invention (which could be replaced by a non-slip end cap) can be flat, rounded, or inclined. It can be placed against a tabletop or wall to provide additional assistance and leverage to a choking victim using my device. However, it is in the design of the head 4 that my invention most clearly supercedes prior efforts in this field.

The attempted exertion of force over too large an area (e.g. using a large disc-shaped head) is unlikely to penetrate deeply and expel sufficient breath to be effective. The resistance provided by the supportive musculature and tissues of the abdominal wall and by the underlying internal organs will resist the application of force applied over too large an area. Further, to the extent such compression can be forced, it is likely to be too gradual to forcefully expel material from the victim's windpipe. In addition, such broadly symmetrical head shapes will be outsized for some victims. Conversely, a symmetrical head that applies force in too small an area may fit more victims, but will penetrate too deeply (with likely damage to underlying tissue) and will not cause the type of volume displacement necessary for the success of the Heimlich Maneuver.

I have discovered that a head 4 with lateral (horizontal) extensions 4A works best in performing the Heimlich Maneuver. A head 4 of this type can easily be produced with a small vertical cross section that allows it to fit between the navel and sternum of victims of many different sizes. It also compresses a large enough area (due to extensions 4A) to create the type of forceful volume expulsion of air necessary for the success of the Heimlich Maneuver. However, it is also able to avoid problems associated with the resistance offered by the vertical bands of muscle in the victim's abdominal region. It does this in a simple and practical way by exerting force across these muscles in a narrow horizontal band via extensions 4A instead of spreading the force in a broadly symmetrical manner. I have found that force exerted in a narrow horizontal band is much harder for the abdominal musculature to resist or blunt. In this respect, the abdominal musculature can be compared to a rigid but bendable bar. It is easier to bend such an item across a narrow linear edge than to bend it without such assistance. In like manner, the narrow horizontal band provided by extensions 4A greatly facilitates the functioning of my invention.

I have also discovered that it is best to have a portion that creates an initial "point of attack" rather than to try to force the entire width of head 4 into the abdomen at the same time. Thus, the head 4 is not only provided with lateral extensions 4A, but with a leading central bulge 5. This bulge 5, like the point of a shovel or the prow of a ship, provides additional mechanical advantage to the user, greatly facilitating the ease with which my invention can be used.

My invention can be manufactured in numerous ways using a wide variety of materials. It can, for example, be produced from wood, elastomers, general rubber products, plastics, metals, laminated boards, plastic foams, and/or any other suitable material. I prefer the use of rigid plastics for spacing rod 1 and handles 2 with a somewhat more flexible semi-rigid foam product being used for head 4. The dimensions of my invention can also very widely. However, I have found that the head 4 can advantageously be produced with a total width (across extensions 4A) of approximately 7.25 inches, a thickness of approximately 2 inches, and with a central bulge 5 extending forward of lateral extensions 4A by approximately 1.5 inches. The length of spacing rod 1 between head 4 and handles 2 of approximately 12 inches has, like the other dimensions described, provided ideal for the use of most people. Pad 3 is approximately 2 inches from handles 2, which may advantageously be covered with plastic grips to make them easier to grasp and hold. However, all of the aforesaid dimensions (while representing a fair average appropriate for most users) are subject to some variation to meet the needs of individual users. Here, as in all other respects, the invention can be subject to wide variation without exceeding the scope of the inventive concept as set forth herein.

I claim:

1. A choking assistance device, including a horizontally elongated head with a body-engaging surface used for compressing the upper abdomen of a choking victim and thereby expelling an object lodged in the choking victim's throat, said body-engaging surface having a horizontally elongated and vertically oblate central bulge extending forward of the remaining portions of said elongated head.

2. A device as described in claim 1, further comprising a linear member attached perpendicularly to said horizontal elongated head opposite said body-engaging surface.

3. A device as described in claim 2, further comprising an end pad adapted for frictional gripping and placement on a surface, said end pad being located at an end of said linear member opposite said head.

4. A device as described in claim 1, further comprising horizontal handles for moving said horizontally elongated head.

5. A device as described in claim 1, further comprising a linear member attached perpendicularly to said horizontally elongated head opposite said body-engaging surface and horizontal handles connected to said horizontally elongated head via said linear member.

6. A device as described in claim 5, wherein said central bulge lies on an axis for said linear member.

7. A device as described in claim 6, further comprising an end pad adapted for frictional gripping and placement on a surface, said end pad being located at an end of said linear member opposite said head.

8. A device as described in claim 6, wherein said central bulge extends forward of the remaining portions of said elongated head by approximately 1.5 inches.

9. A device as described in claim 6, wherein the distance between said head and said handles is approximately 12 inches.

10. A device as described in claim 5, further comprising an end pad adapted for frictional gripping and placement on a surface, said end pad being located at an end of said linear member opposite said head.

11. A device as described in claim 1, wherein said central bulge lies on an axis for said linear member.

12. A device as described in claim 11, further comprising an end pad adapted for frictional gripping and placement on a surface, said end pad being located at an end of said linear member opposite said head.

13. A choking assistance device, including a horizontally elongated head with a body-engaging surface used for compressing the upper abdomen of a choking victim and thereby expelling an object lodged in the choking victim's throat, wherein said horizontally elongated head is approximately 7.25 inches long and the body-engaging surface of said head is approximately 2 inches wide.

14. A device as described in claim 13, further comprising a linear member attached perpendicularly to said horizontally elongated head opposite said body-engaging surface; horizontal handles connected to said horizontally elongated head via said linear member; a central bulge in said body-engaging surface lying on an axis for said linear member; and an end pad adapted for frictional gripping and placement on a surface said end pad being located at an end of said linear member opposite said head.

15. A device as described in claim 14, wherein said central bulge extends forward of the remaining portions of said elongated head by approximately 1.5 inches.

16. A device as described in claim 15, wherein the distance between said head and said handles is approximately 12 inches.

17. A device as described in claim 14, wherein the distance between said head and said handles is approximately 12 inches.

18. A choking assistance device including a horizontally elongated head with a body-engaging surface used for compressing the upper abdomen of a choking victim and thereby expelling an object lodged in the choking victim's throat, the body-engaging surface having a central bulge extending forward of the remaining portions of said elongated head by approximately 1.5 inches.

* * * * *